US005658185A

United States Patent [19]

Morgan, III et al.

[11] Patent Number: 5,658,185

[45] Date of Patent: Aug. 19, 1997

[54] CHEMICAL-MECHANICAL POLISHING APPARATUS WITH SLURRY REMOVAL SYSTEM AND METHOD

[75] Inventors: Clifford Owen Morgan, III, Burlington; Dennis Arthur Schmidt, South Burlington; Philip Nicholas Theodoseau, Richmond, all of Vt.

[73] Assignee: International Business Machines Corporation

[21] Appl. No.: 547,751

[22] Filed: Oct. 25, 1995

[51] Int. Cl.[6] ..... B24B 1/00; B24C 9/00

[52] U.S. Cl. ..... 451/36; 451/41; 451/60; 451/87; 451/288; 451/290; 451/446; 438/693

[58] Field of Search ..... 156/345, 636.1; 216/88, 89; 437/225, 946; 451/36, 41, 60, 87, 273, 274, 287, 288, 289, 290, 446

[56] References Cited

U.S. PATENT DOCUMENTS

| | | | |
|---|---|---|---|
| 2,780,038 | 2/1957 | Laverdisse | 451/60 |
| 2,935,823 | 5/1960 | Heymes | 451/446 X |
| 3,549,439 | 12/1970 | Kaveggia et al. . | |
| 4,313,284 | 2/1982 | Walsh | 451/289 X |
| 4,490,948 | 1/1985 | Hanstein et al. | 451/446 X |
| 4,869,779 | 9/1989 | Acheson | 216/89 |
| 5,216,843 | 6/1993 | Breivogel et al. | 451/285 |
| 5,232,875 | 8/1993 | Tuttle et al. | 437/225 |
| 5,246,525 | 9/1993 | Sato | 156/345 |
| 5,329,734 | 7/1994 | Yu | 451/41 |
| 5,554,064 | 9/1996 | Breivogel et al. | 451/446 X |

FOREIGN PATENT DOCUMENTS

| | | | |
|---|---|---|---|
| 0 593 057 | of 1994 | European Pat. Off. . | |
| 63-312058 | 12/1988 | Japan | 451/446 |
| 1-321161 | 12/1989 | Japan | 451/446 |
| 2-100321 | 4/1990 | Japan | 451/446 |
| 6-39703 | 1/1994 | Japan | 451/446 |
| 6-763 | 1/1994 | Japan | 451/290 |

*Primary Examiner*—Timothy V. Eley
*Attorney, Agent, or Firm*—Heslin & Rothenberg, P.C.

[57] ABSTRACT

An apparatus and method for improving planarity of chemical-mechanical polishing of substrates are provided. The apparatus includes a platen having a planar surface upon which a polishing pad is removably affixed. The pad has an exposed planar surface, and a carrier removably holds the substrate against the planar surface. The apparatus includes a slurry distribution system and a slurry removal system. The slurry distribution system provides slurry to an instantaneous interface area of the substrate and planar surface through the platen and pad, while the slurry removal system removes slurry from the instantaneous interface area through the pad and the platen, notwithstanding rotation of the platen and/or substrate, as well as linear movement of the substrate relative to the rotating platen.

25 Claims, 4 Drawing Sheets

CHEMICAL-MECHANICAL POLISHING APPARATUS WITH SLURRY REMOVAL SYSTEM AND METHOD

TECHNICAL FIELD

The present invention relates to a polishing apparatus and a method for performing a polishing operation. More particularly, the invention relates to an integrated circuit manufacturing technology process for grinding or polishing a surface of a wafer-type substrate, such as a semiconductor wafer, in order to achieve a controlled degree of planarity and/or to remove a film.

BACKGROUND ART

In the manufacture of integrated circuits, wafer surface planarity is of extreme importance. Photolithographic processes are typically pushed close to the limit of resolution in order to create maximum circuit density. For 16 megabit dynamic random access memories, minimum critical dimensions, such as word line and bit line width, will initially be in the 0.5μ–0.7μ range. Since these geometries are photolithographically produced, it is essential that the wafer surface be highly planar so that the electromagnetic radiation used to create a mask may be accurately focused at a single level, thus resulting in precise imaging over the entire surface of the wafer. Were the wafer surface sufficiently non-planar, the resulting structures would be poorly defined, with the circuit being either nonfunctional or, at best, endowed with less than optimum performance.

In order to achieve the degree of planarity required to produce ultra high density integrated circuits, chemical-mechanical polishing or planarization processes are employed. In general, chemical-mechanical polishing (CMP) processes involve holding a semiconductor wafer against a moving polishing surface that is wetted with a chemically reactive, abrasive slurry. Slurries are usually either basic or acidic and generally contain alumina or silica particles. The polishing surface is typically a planar pad made of relatively soft, porous material such as blown polyurethane. The pad is usually mounted on a planar platen.

FIG. 1 depicts a conventional rotational CMP apparatus, generally denoted 10. The apparatus comprises a wafer carrier 11 for holding a semiconductor wafer 12. A soft, resilient pad 13 is typically placed between the wafer carrier 11 and the wafer 12, and the wafer is generally held against the resilient pad by a partial vacuum, friction, or adhesive, etc. Frictional affixation may be accomplished by placing a resilient backing pad of uniform thickness between the carrier and the wafer, the backing pad having a higher co-efficient of friction with respect to the wafer and carrier surface with which it is in contact on opposite sides than the co-efficient of friction of the wafer with respect to the slurry saturated polishing pad. The wafer carrier 11 is designed to be continuously rotated by a drive motor 14. In addition, the wafer carrier 11 is also designed for transverse movement as indicated by the double headed arrow 15. The rotational and transverse movement is intended to reduce variability and material removal rates over the surface of wafer 12. The apparatus further comprises a rotating platen 16 on which is mounted a polishing pad 17. The platen is relatively large in comparison to the wafer 12, so that during the CMP process, the wafer 12 may be moved across the surface of the polishing pad 17 by the wafer carrier 11. A polishing slurry containing chemically-reactive solution, in which are suspended abrasive particles, is deposited through a supply tube 18 onto the surface of polishing pad 17.

FIG. 2 illustrates the basic principles of the conventional rotational CMP process. The polishing pad 17 is rotated at an angular velocity of $W_p$ radians per second (rads./sec.) about axis O. The wafer to be planarized 12 is rotated at an angular velocity of $W_w$rads./sec., typically in the same rational sense as the pad. It is easily understood that the linear speed (L) of the polishing pad in centimeters/sec., at any given radius (R) in centimeters from axis O, will be equal to $W_p r$. Experience has demonstrated that the rate of removal of material from the wafer surface is related to the speed with which the pad surface makes contact with the wafer surface.

There are a number of disadvantages associated with the conventional CMP process. For example, most existing CMP systems employ gravity or other means for forcing the wafer against the polishing surface of the pad with an object that a certain amount of slurry remain disposed between the two structures. In conventional CMP, there is no mechanism for addressing the quantity or quality of the slurry disposed between the wafer and polishing pad. Rather, the hope is that a certain portion of the slurry pumped onto the polishing pad will make it between the wafer and pad. U.S. Pat. No. 5,232,875 entitled "Method and Apparatus of Improving Planarity of Chemical-Mechanical Planarization Operations," addresses a portion of this issue. Specifically, this patent documents a chemical-mechanical polishing apparatus wherein slurry is fed from a supply to a network of channels beneath the polishing pad and from there through open pores which extend from a lower surface of the pad to the upper surface of the pad, thereby supplying slurry directly to the wafer-pad interface. Unfortunately, this CMP approach does not address the issue of quality of the slurry at the waferpad interface.

Specifically, debris or film from the surface of the wafer undergoing polishing can be trapped between the wafer and polishing pad, which if unremoved could result in scarring of the wafer surface. Thus, a need still exists in the art for a technique for ensuring/improving the quality of slurry at the interface between a wafer and polishing pad of a chemical-mechanical polishing apparatus. The present invention addresses this need.

DISCLOSURE OF THE INVENTION

Briefly summarized, the invention comprises in a first aspect a polishing tool including a platen for supporting a polishing pad having a surface for interfacing with a workpiece to be polished, and a slurry distribution system and a slurry removal system. The slurry distribution system provides polishing slurry through the platen and the polishing pad to the interface area of the polishing surface with the workpiece to be polished, while the slurry removal system removes slurry from the interface area of the polishing surface and workpiece through the polishing pad and the platen.

In a more specific aspect, the invention comprises a chemical-mechanical polishing (CMP) apparatus having a platen with a planar surface upon which a pad is removably affixed. The pad presents a polishing surface for interfacing with a substrate. The substrate is removably attached to a carrier which holds the substrate against the polishing surface of the pad. A slurry distribution system provides slurry through the platen and the pad to the polishing surface thereof and a slurry removal system removes slurry from the polishing surface through the pad and the platen. Slurry is provided and removed directly at the interface area of the substrate and polishing surface.

In still another aspect, a method for polishing a substrate is presented. The method employs a polishing surface disposable against the substrate such that an interface area of the substrate to the polishing surface is defined. The polishing surface resides on a platen. The method comprises: rotating the platen and polishing surface relative to the substrate; injecting a slurry through the platen to the polishing surface within the interface area; and simultaneous with injecting of said slurry, removing slurry from the interface area of the polishing surface through the platen. Preferably, the injecting and removing of slurry are performed to establish an equilibrium of slurry within the interface area of the substrate to the polishing surface.

A chemical-mechanical polishing (CMP) apparatus and method in accordance with this invention encompass numerous advantages over conventional CMP approaches. For example, slurry is supplied to and removed from the area of greatest importance, i.e., the instantaneous interface area of a workpiece, such as a substrate or wafer, with the polishing surface of the apparatus, notwithstanding rotation of the platen and/or workpiece as well as movement of the workpiece linearly relative to the platen. This results in improved slurry quality and control at the instantaneous interface of the workpiece/polishing pad surface. In the case of a semiconductor wafer, an improved wafer surface is obtained upon which to produce topography for reduced depth of focus for photolithography systems. Thus resulting in an increased productivity by decreasing cycle time, decreasing rework requirements for CMP processed wafers, and increasing yields by decreasing overall wafer handling requirements.

BRIEF DESCRIPTION OF DRAWINGS

The subject matter which is regarded as the present invention is particularly pointed out and distinctly claimed in the concluding portion of the specification. The invention, however, both as to organization and methods of practice, together with further objects and advantages thereof, may best be understood by reference to the following detailed description taken in conjunction with the accompanying drawings in which:

BEST MODE FOR CARRYING OUT THE INVENTION

Figure 1:
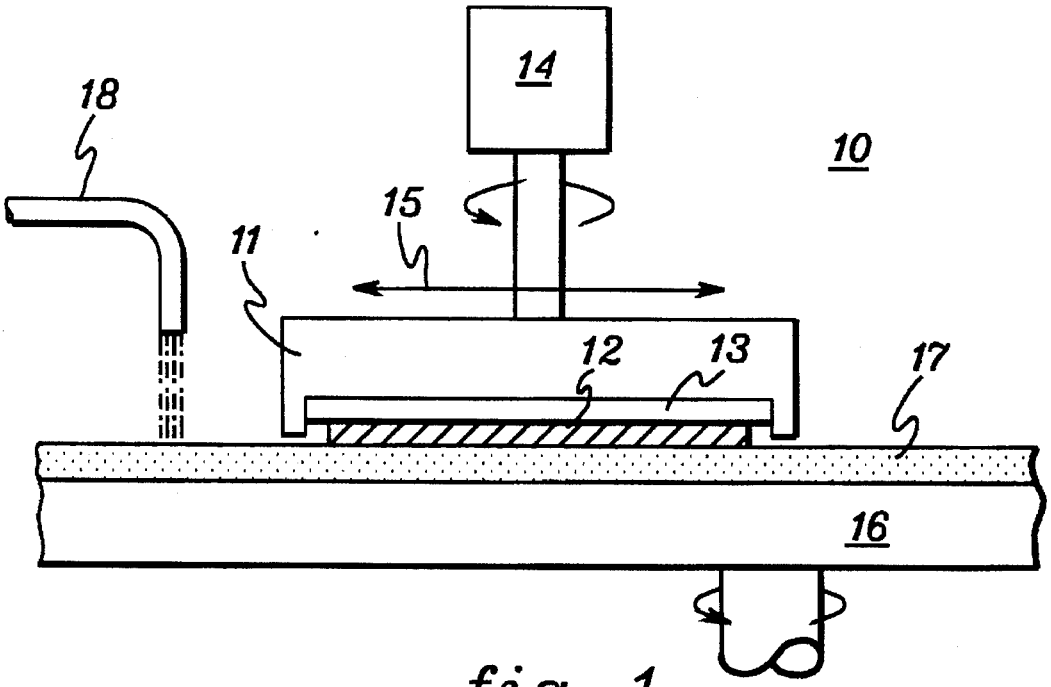
fig. 1 (PRIOR ART)
FIG. 1 is an elevational side view of a conventional rotational chemical-mechanical polishing apparatus.
Figure 2:
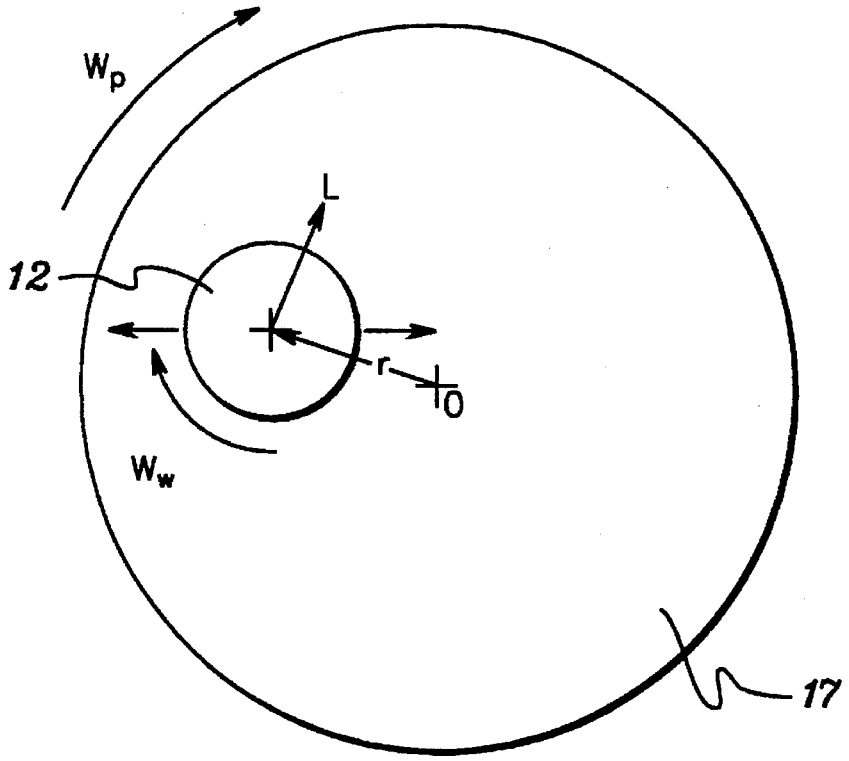
fig. 2 (PRIOR ART)
FIG. 2 is a top plan view of a wafer and polishing pad in the conventional chemical-mechanical polishing apparatus of FIG. 1.
Figure 3:
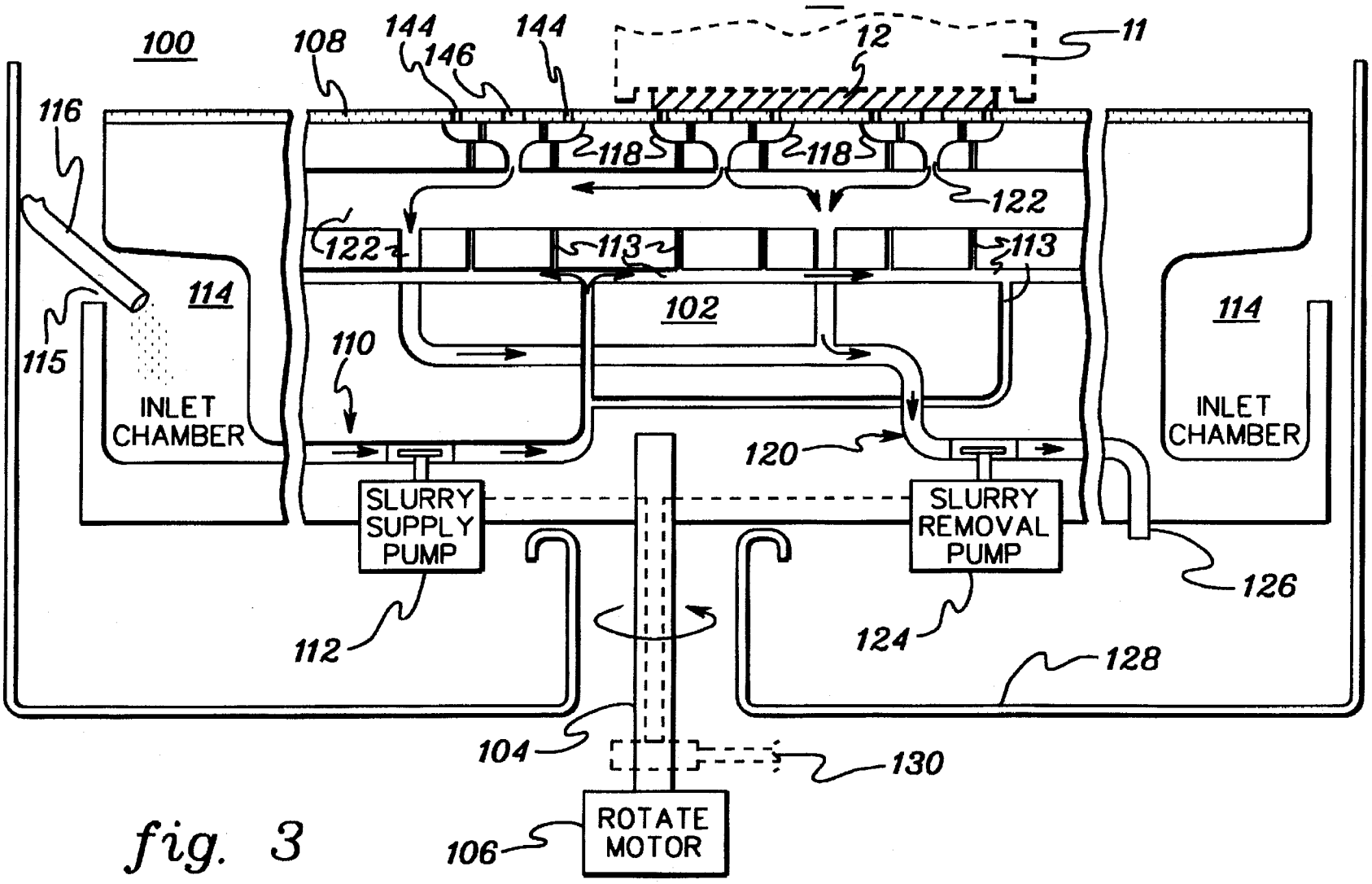
FIG. 3 is a partial cross-sectional elevational view of one embodiment of a chemical-mechanical polishing apparatus in accordance with the present invention.
Figure 4A:
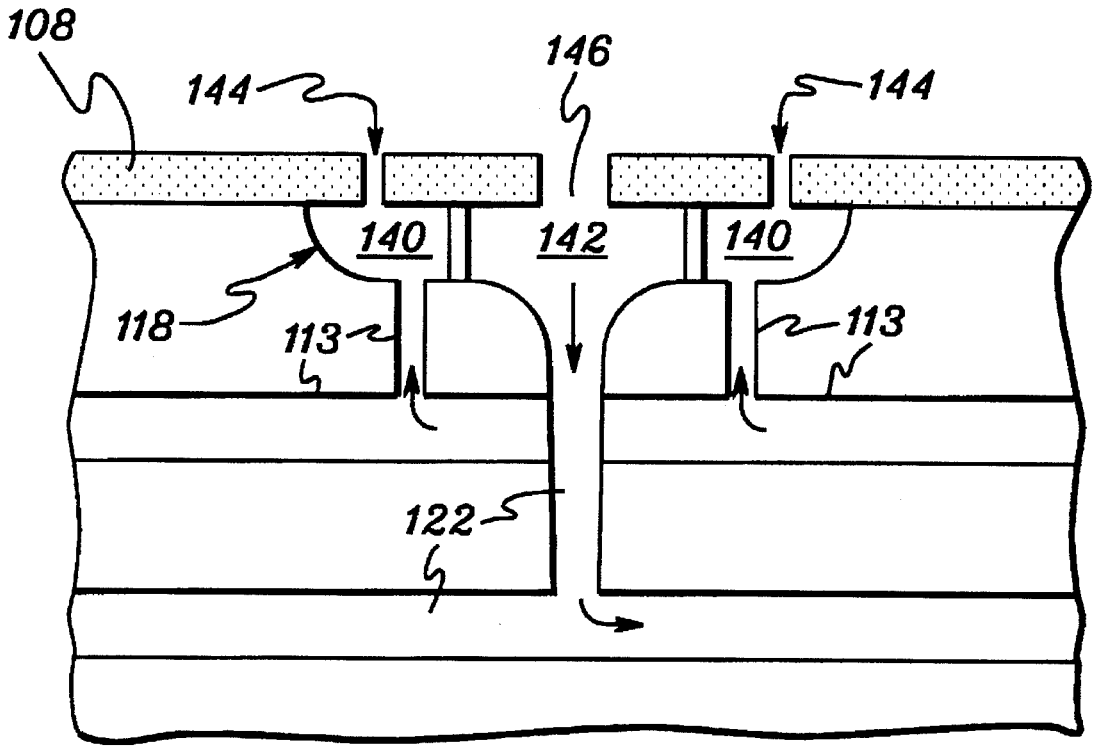
FIGS. 4*a* & 4*b* depict in greater detail a slurry delivery system and a slurry removal system for a chemical-mechanical polishing apparatus in accordance with the present invention.
Figure 4B:
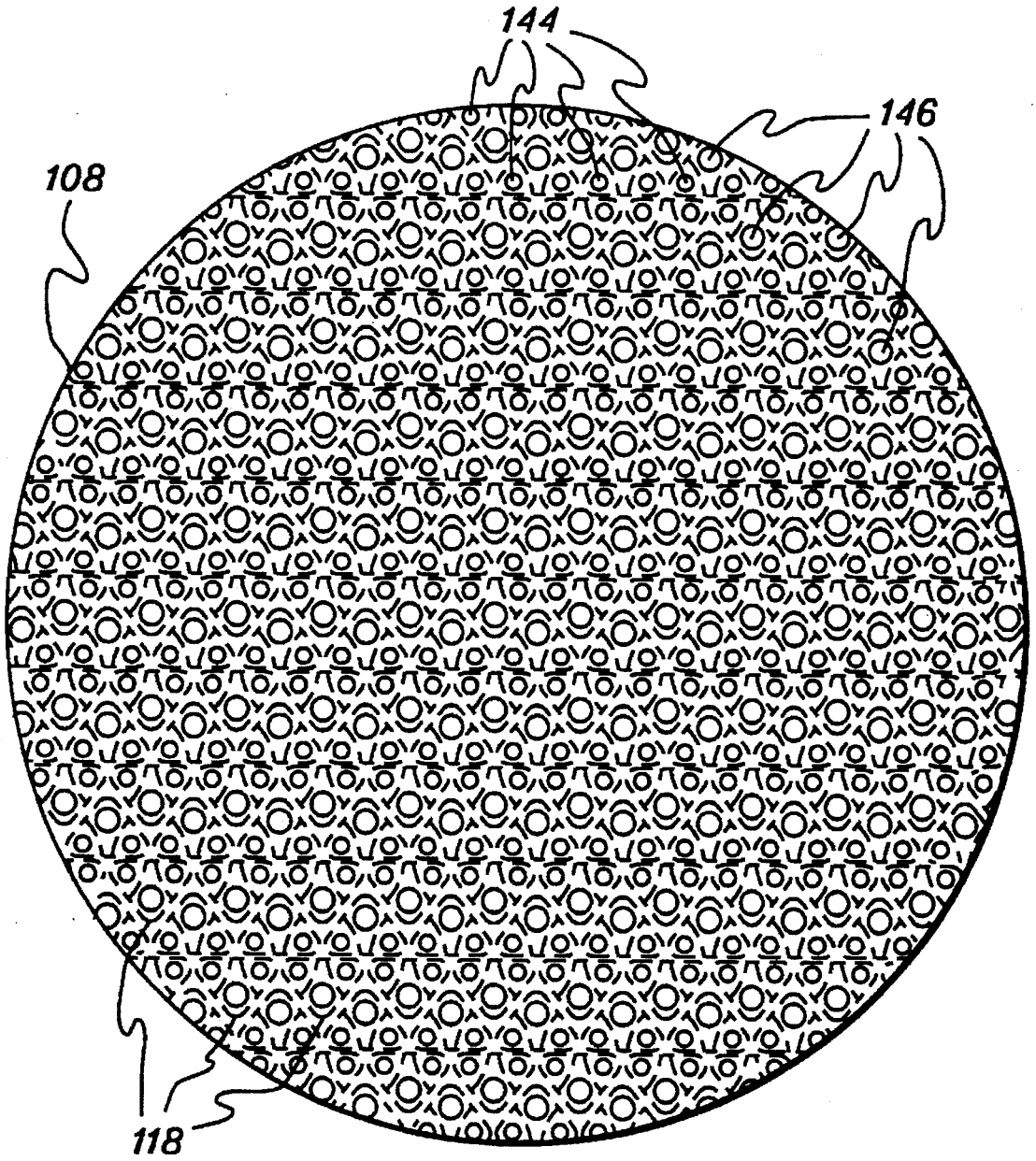

One embodiment of a chemical-mechanical polishing (CMP) apparatus, generally denoted 100, in accordance with the present invention is depicted in FIGS. 3–4*b*. CMP apparatus 100 includes a platen 102 connected to a rotatable shaft 104 driven by a motor 106. A polishing pad 108 is disposed at a horizontal, planar upper surface of platen 102. Pursuant to the invention, the platen and pad include a slurry distribution system 110 and a slurry removal system 120. Slurry distribution system 110 comprises a first channel system 113 through platen 102, a slurry supply pump 112 and a circumferentially formed inlet chamber or reservoir 114 having a circumferential opening 115 through which a non-rotating slurry feed tube 116 supplies slurry. Pump 112 controls pumping of slurry from chamber 114, through first channel system 113, to a plurality of slurry exchange tubs 118, from which the slurry passes to polishing pad 108. Pad 108 includes an array of openings 144 therethrough, each of which is in fluid communication with a corresponding chamber 140 of a slurry exchange tub for transfer of slurry to the polishing surface of the pad, including the area comprising an immediate or "instantaneous interface" of a wafer 12 with the exposed polishing surface of pad 108. Wafer 12 is maintained against the polishing pad by a conventional carrier 11 (partially shown in phantom). Polishing pad 108 preferably comprises a porous pad, which may or may not have conventional perforations or grooves therein for facilitating the retention and distribution of slurry at the polishing surface.

Film removed from the wafer and other debris, which is suspended within the slurry, is removed from the exposed surface of polishing pad 108 through slurry removal system 120, which includes a second channel system 122 within the platen in fluid communication with a second array of openings 146 throughout pad 108. Slurry can be controllably pumped from second channel system 122 by a slurry removal pump 124 for dispensing through a discharge tube 126 into an appropriately sized, non-rotating slurry containment tank 128 surrounding rotating platen 102. Although not shown, discharged slurry could undergo conditioning to remove debris suspended therein, if desired, and be reintroduced into the polishing process at inlet chamber 114 via inlet tube 116. Pumps 112 & 124 are conventional type slurry pumps which are electrically controllable. These pumps are connected to a power source via wiring 130 across commutating contacts.

Slurry exchange tubs 118, which are preferably disposed across the entire upper surface of platen 102, are shown in greater detail in FIGS. 4*a* & 4*b*. In this embodiment, each tub 118 is configured with two outer chambers 140 and a central chamber 142. Outer chambers 140 comprise slurry chambers for holding slurry to be forced through corresponding openings 144 of the first array of openings 144 in polishing pad 108, while central chamber 142 receives slurry with debris suspended therein from a corresponding opening 146 of the second array of openings 146 in polishing pad 108. Chambers 140 are in fluid communication with first channel system 113, while central chambers 142 discharge slurry through second channel system 122 of the slurry removal system.

Numerous variations on the basic concept presented herein will be apparent to one skilled in the art. For example, a simple matrix of slurry delivery tubes and slurry removal tubes could be arrayed within the platen and polishing pad. Alternatively, varies geometric shaped tubs could be employed within the platen to facilitate exchange of slurry at the polishing surface of the polishing pad. For example, a circular shaped tub configuration is possible wherein a central slurry outlet is ringed by a plurality of slurry inlets, for example, of smaller diameter than the slurry outlet. In any design, one significant consideration is that slurry equilibrium should be maintained at the polishing surface of the polishing pad. Thus, slurry injection rates should be balanced with slurry removal rates, for example, either through sizing of the openings or providing of an appropriate pressure differential between inlets and outlets using the slurry pumps. Again, the central concept presented herein is to maintain in a controllable manner a desired quantity and quality of slurry at the interface of the wafer and polishing pad, notwithstanding that the polishing pad and/or wafer may be rotating, as well as moving linearly with respect to each other.

Those skilled in the art will note from the above discussion that a chemical-mechanical polishing (CMP) apparatus and method in accordance with this invention encompass numerous advantages over conventional CMP approaches. For example, slurry is supplied to and removed from the area of greatest importance, i.e., the instantaneous interface area of a workpiece, such as a substrate or wafer, with the polishing surface of the apparatus, notwithstanding rotation of the platen and/or workpiece, as well as movement of the workpiece linearly relative to the platen. This results in improved slurry quality and control at the instantaneous interface of the workpiece/polishing pad surface. In the case of a semiconductor wafer, an improved wafer surface is obtained upon which to produce topography for reduced depth of focus for photolithography systems. Thus resulting is in increased productivity by decreasing cycle time, decreasing rework requirements for CMP processed wafers, and increasing yields by decreasing overall wafer handling requirements.

Further, by providing an array of slurry delivery openings and an array of slurry removal openings in close proximity throughout the polishing pad, it is insured that at least a portion of the arrays of openings will be at the interface area of the wafer and polishing surface in order that slurry may be directly injected to and removed from this interface area. Since the platen and/or wafer are rotating and preferably linearly moving with respect to each other, disposition of the openings throughout the polishing pad and platen ensure this ability to deliver and remove slurry at the area between the wafer and polishing surface irrespective of where the interface area of the wafer and polishing surface is at any given time (referred to herein as the "instantaneous interface area").

While the invention has been described in detail herein in accordance with certain preferred embodiments thereof, many modifications and changes therein may be effected by those skilled in the art. Accordingly, it is intended by the appended claims to cover all such modifications and changes as fall within the true spirit and scope of the invention.

We claim:

1. A method for polishing a substrate employing a polishing surface disposed against the substrate such that an interface area of the substrate to the polishing surface is defined, said polishing surface residing on a platen, said method comprising the steps of:

(a) rotating the platen and polishing surface relative to said substrate;

(b) injecting a slurry through the platen to the polishing surface within said interface area; and (c) simultaneous with said step (b), removing slurry from said interface area of said polishing surface through said platen.

2. The method of claim 1, further comprising simultaneously performing said steps (b) & (c) such that an equilibrium is established within said interface area between injecting of said slurry and removing of said slurry.

3. A polishing tool comprising:

a platen for supporting a polishing pad having a support surface for interfacing with a workpiece to be polished;

means for rotating the platen and the polishing pad supported thereon;

a slurry distribution system for providing polishing slurry through the platen and the polishing pad to said support surface for interfacing with said workpiece to be polished; and a slurry removal system for removing polishing slurry from said support surface through the polishing pad and platen.

4. The polishing tool of claim 3, wherein said slurry removal system removes polishing slurry from said support surface through the polishing pad and the platen in an area of said support surface at least partially beneath an interface thereof with the workpiece to be polished.

5. The polishing tool of claim 4, further comprising means for moving the workpiece to be polished relative to said support surface of said rotating polishing pad, and wherein said slurry distribution system includes a first array of openings in said polishing pad for providing polishing slurry to said support surface thereof, and wherein said slurry removal system includes a second array of openings in said polishing pad for removing polishing slurry from said support surface.

6. The polishing tool of claim 5, wherein said slurry distribution system further comprises a first channel system within said platen in fluid communication with said first array of openings in said polishing pad for delivering said polishing slurry to said support surface, and wherein said slurry removal system includes a second channel system within said platen in fluid communication with said second array of openings in said polishing pad for removing polishing slurry from said support surface.

7. The polishing tool of claim 6, wherein said first channel system includes an inlet chamber for holding a polishing slurry to be supplied through said first channel system and said first array of openings to said support surface, and wherein said second channel system includes a discharge tube for discharging polishing slurry from said support surface.

8. The polishing tool of claim 7, wherein said slurry distribution system further comprises a slurry supply pump for pumping polishing slurry through said first channel system and said first array of openings to said support surface, wherein said slurry removal system further comprises a slurry removal pump for pumping polishing slurry from said support surface, through said second array of openings and said second channel system, to said discharge tube.

9. The polishing tool of claim 8, wherein said slurry supply pump and said slurry removal pump are each affixed to said platen so as to rotate therewith.

10. The polishing tool of claim 7, further comprising a containment tank surrounding said platen for collecting polishing slurry discharged by said slurry removal system through said discharge tube.

11. The polishing tool of claim 5, further comprising a plurality of tubs formed in a surface of said platen supporting said polishing pad, each tub of said plurality of tubs having a first chamber in fluid communication with at least one opening of said first array of openings and a second chamber in fluid communication with at least one opening of said second array of openings.

12. A chemical-mechanical polishing (CMP) apparatus comprising:

a platen having a planar surface;

a pad removably affixed to said planar surface, said pad having a polishing surface;

means for rotating said platen and pad;

a carrier having a planar surface to which a first side of a substrate is removably attachable, a second side of said substrate being disposable against said polishing surface;

a slurry distribution system for providing slurry through the platen and the pad to the polishing surface; and a slurry removal system for removing slurry from the polishing surface through the pad and the platen.

13. The CMP apparatus of claim 12, wherein said slurry distribution system includes first means for controlling flow of said slurry to the polishing surface, and wherein said slurry removal system includes second means for controlling removing of slurry from said polishing surface.

14. The CMP apparatus of claim 12, wherein said slurry removal system removes slurry from the polishing surface through the pad in an area of said polishing surface at least partially overlapping an interface thereof with said second side of said substrate.

15. The CMP apparatus of claim 14, wherein said slurry distribution system provides slurry to the polishing surface through the pad in an area at least partially overlapping said interface of said polishing surface and said second side of said substrate.

16. The CMP apparatus of claim 15, further comprising means for linearly moving said carrier relative to said rotating platen.

17. The CMP apparatus of claim 16, wherein said slurry distribution system includes a first channel system in said platen and a slurry supply pump interfacing therewith for pumping slurry through said first channel system to said polishing surface, and wherein said slurry removal system includes a second channel system within said platen for facilitating removal of slurry from the polishing surface and a discharge mechanism coupled to said second channel system for discharging slurry therefrom.

18. The CMP apparatus of claim 17, wherein said discharge mechanism includes a slurry removal pump coupling said second channel system to a discharge tube for pumping slurry from said second channel system.

19. The CMP apparatus of claim 18, wherein said slurry distribution system further comprises an inlet chamber in said platen in fluid communication with said first channel system, said inlet chamber for holding slurry to be supplied to said polishing surface.

20. The CMP apparatus of claim 12, wherein said planar surface of said platen includes a plurality of slurry tubs, each slurry tub comprising part of at least one of said slurry distribution system and said slurry removal system.

21. The CMP apparatus of claim 12, wherein disposing of said second side of said substrate against said polishing surface defines an instantaneous interface area, and wherein said slurry distribution system includes a first plurality of openings in said pad within said instantaneous interface area for providing slurry to the polishing surface, and wherein said slurry removal system includes a second plurality of openings in said pad within said instantaneous interface area for removing slurry from the polishing surface through the pad.

22. The CMP apparatus of claim 21, wherein said first plurality of openings comprise a portion of a first array of openings throughout said pad and said second plurality of openings comprise a portion of a second array of openings throughout said pad.

23. The CMP apparatus of claim 22, further comprising means for linearly moving said carrier and substrate relative to said platen when said platen is rotating.

24. A chemical-mechanical polishing apparatus comprising:

a platen having a planar surface;

a pad removably affixed to said planar surface, said pad having a polishing surface;

a carrier having a planar surface to which a first side of a substrate is removably attachable, a second side of said substrate being disposable against said polishing surface;

a slurry distribution system for providing slurry through the platen and the pad to the polishing surface;

a slurry removal system for removing slurry from the polishing surface through the pad and the platen;

wherein said planar surface of said platen includes a plurality of slurry tubs, each slurry tub comprising part of at least one of said slurry distribution system and said slurry removal system; and wherein each tub of said plurality of tubs includes a first portion comprising part of said slurry distribution system and a second portion comprising part of said slurry removal system, said first portion comprising a first chamber for holding slurry to be provided through the pad to the polishing surface, said second portion comprising a second chamber for collecting slurry removed from said polishing surface through the pad.

25. The CMP apparatus of claim 24, wherein each tub of said plurality of tubs has a substantially triangular configuration with a central portion in communication with at least one opening in said pad for removing slurry from the exposed polishing surface, said central portion comprising said second portion and an outer portion for providing slurry through at least one opening in the pad to said polishing surface, said outer portion comprising said first portion.

* * * * *